US010669742B1

(12) United States Patent
Williams

(10) Patent No.: US 10,669,742 B1
(45) **Date of Patent: *Jun. 2, 2020**

(54) METHOD FOR OPENING A COMBINATION PADLOCK

(75) Inventor: Andrew O. Williams, Arlington, TX (US)

(73) Assignee: Lockheed Corporation, Fort Worth, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 07/629,456

(22) Filed: Dec. 18, 1990

Related U.S. Application Data

(62) Division of application No. 07/491,358, filed on Mar. 9, 1990.

(51) Int. Cl.
*E05B 19/20* (2006.01)

(52) U.S. Cl.
CPC ..... *E05B 19/20* (2013.01)

(58) Field of Classification Search
USPC ..... 70/446, 442, 330–332, 263; 109/49.5
See application file for complete search history.

(56) References Cited

U.S. PATENT DOCUMENTS

| | | | | | |
|---|---|---|---|---|---|
| 2,393,465 | A | * | 1/1946 | Gray | 70/446 |
| 4,056,956 | A | * | 11/1977 | Gilliam | 70/446 |
| 4,433,563 | A | * | 2/1984 | Wilson | 70/446 |
| 4,803,860 | A | * | 2/1989 | Moore | 70/446 |

FOREIGN PATENT DOCUMENTS

| | | | | |
|---|---|---|---|---|
| GB | 922661 | * | 4/1963 | 70/446 |

* cited by examiner

*Primary Examiner* — Bret Hayes
(74) *Attorney, Agent, or Firm* — Baker Botts L.L.P.

(57) ABSTRACT

The combination padlock is of the type having a shackle, a dial for rotating a drive cam having a gate slot, a plurality of rotatable wheels or tumblers each with gate slots, and a fence for allowing the shackle to be opened when all of the gate slots are aligned with the fence.

In carrying out the method, the dial is manipulated to sequentially align the gate slot of each wheel with the fence by incremental movement thereof and while the gate slot of the drive cam is aligned with the fence, applying force between the shackle and casing to measure movement of the shackle relative to the casing at each increment position of at least two of the wheels to determine the combination number of each wheel and/or to open the shackle.

A frame is provided with structure for releasably securing the casing member in a first embodiment, and the shackle member in a second embodiment, to the frame wherein the unsecured shackle member or casing member is free to move relative to the frame. Also provided is a movement sensitive device for sensing movement between the shackle and the casing while force is applied between the shackle and casing to determine the combination numbers.

7 Claims, 5 Drawing Sheets

120T
120
120A
20C
20B
20
20B1
20A
17
24
23A
23
22
21A
21
21D
AX
118
118T
118A
18B
18C
18BA
18
18D
18A
119A
119
119T
19C
19B
19
19D
19A
19BA

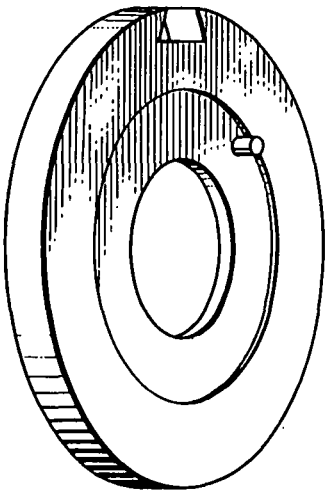
Fig. 3
Fig. 2
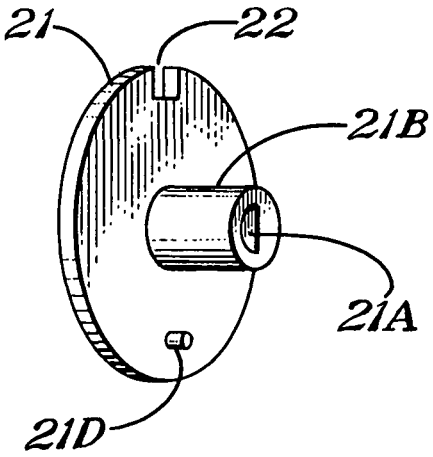
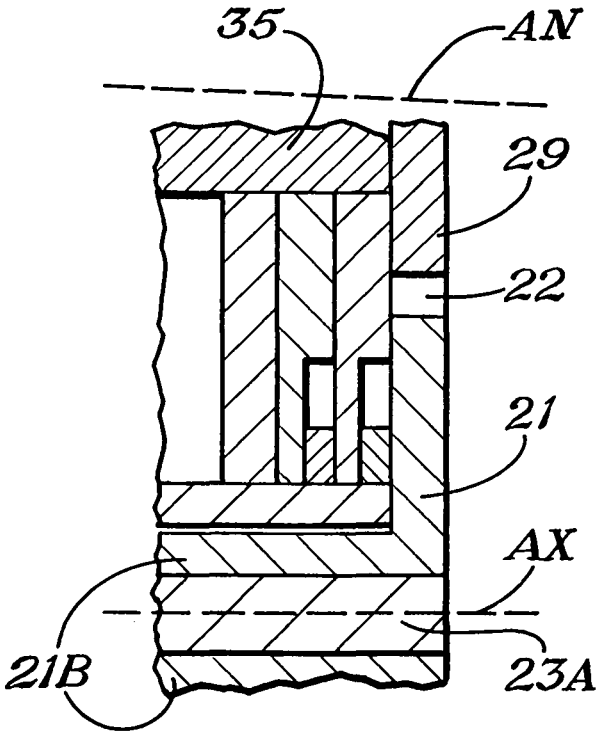
Fig. 5
Fig. 4
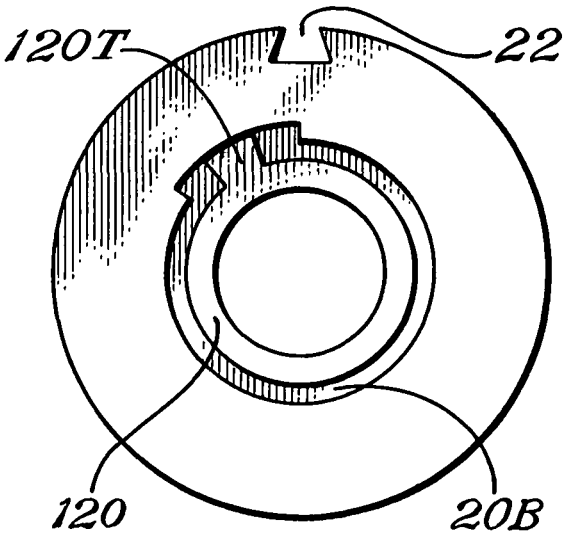

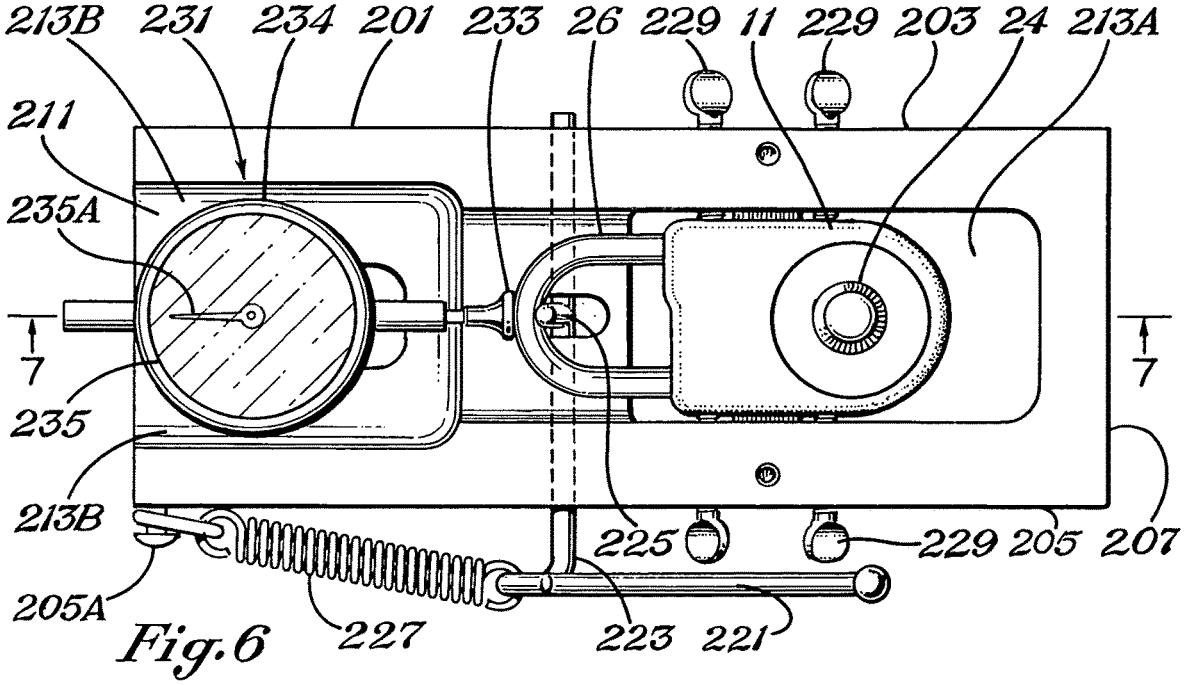
Fig. 6
Fig. 7
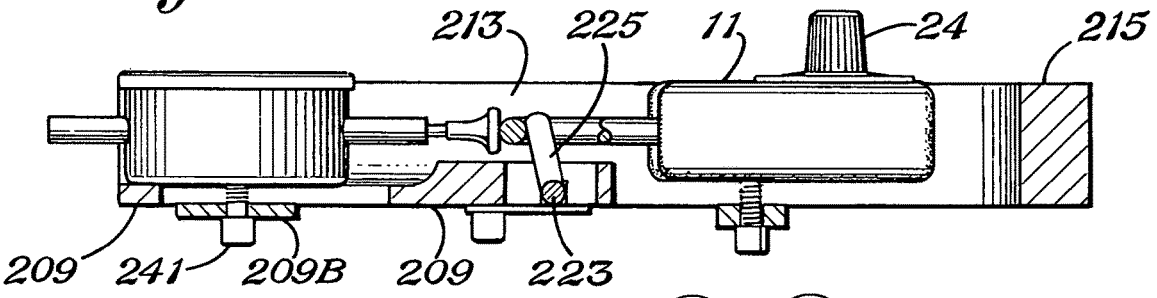
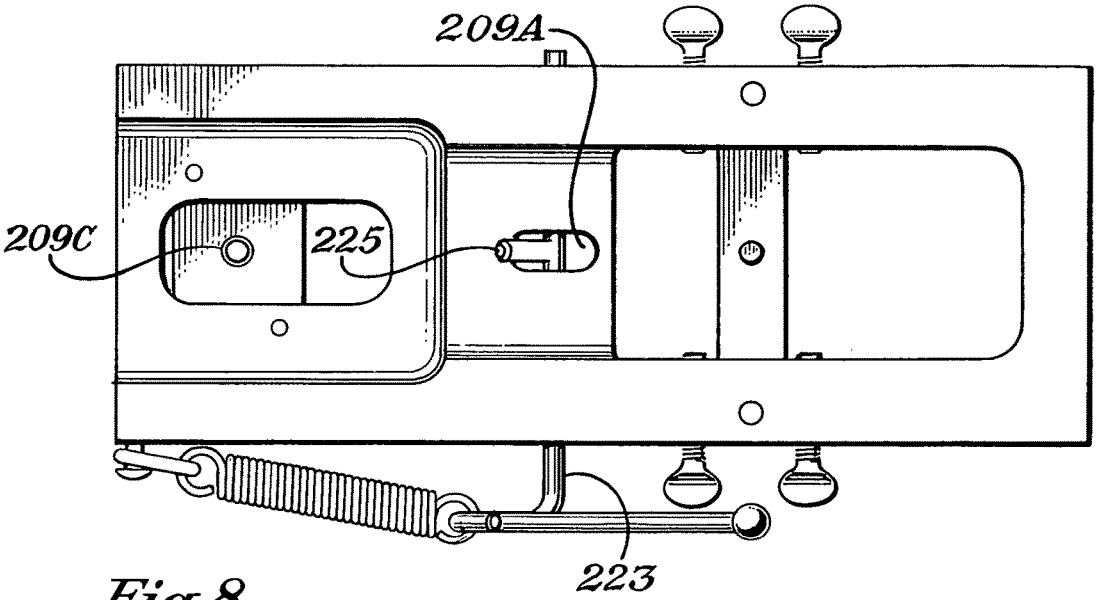
Fig. 8

METHOD FOR OPENING A COMBINATION PADLOCK

This application is a divisional application of application Ser. No. 07/491,358, filed on Mar. 9, 1990.

FIELD OF THE INVENTION

The invention relates to an apparatus and method for finding the number combination of a locked combination padlock having a shackle.

BACKGROUND OF THE INVENTION

Combination padlocks of the type disclosed in U.S. Pat. No. 2,673,457 are used extensively and in many cases the combination is lost requiring replacement of the padlock which is expensive. The padlock of this patent has three wheels with gate slots and a drive cam for rotating the three wheels in alignment with a fence for allowing the shackle to be moved to an open position. The padlock has structure including a gate slot or recess in the drive cam and a finger portion at the end of its fence for reducing the possibility of unauthorized persons from detecting the combination for unlocking the lock.

SUMMARY OF THE INVENTION

It is an object of the invention to provide an apparatus and process for determining the combination of a locked padlock having a shackle, a dial for rotating a drive cam having a gate slot, a plurality of rotatable wheels or tumblers each with gate slots, and a fence for allowing the shackle to be opened when all of the gate slots are aligned with the fence.

In carrying out the method, on one type of padlock, the dial is manipulated to sequentially align the gate slot of each wheel with the fence by incremental movement thereof and while the gate slot of the drive cam is aligned with the fence, applying an opening force between the shackle and casing so as to measure movement of the shackle relative to the casing at each increment position of at least two of the wheels to determine the combination number of each wheel and/or to open the shackle.

The apparatus comprises a frame and means for releasably securing the casing member, in a first embodiment, and the shackle member, in a second embodiment, to the frame wherein the unsecured shackle member or casing member is free to move relative to the frame. Also provided is a movement sensing means having a body, a moveable means supported by said body, and an indicator carried by said body for indicating movement of said moveable means. Means are provided for securing said body of said movement sensing means to the frame in a given position such that said body cannot move relative to said frame and said movable means is located to sense movement of the unsecured member.

The second embodiment allows one to determine the combination while the padlock is attached to structure locked by the padlock.

BRIEF DESCRIPTION OF THE DRAWINGS

FIG. 2 illustrates the front side of the drive cam of a combination type padlock.

FIG. 3 illustrates the front side of one of the wheels or tumblers thereof.

FIG. 4 is a plan rear view of one of the wheels or tumblers of the padlock.

FIG. 5 is a partial cross-sectional view of the three wheels and the drive cam and the fence of the padlock when assembled as in U.S. Pat. No. 2,673,457.

FIG. 6 is a top plan view of one embodiment of the apparatus of the invention showing the dial indicator and a combination lock in place to be opened.)

FIG. 7 is a cross-sectional view of the frame of FIG. 6 taken along the lines 7-7 thereof.

FIG. 8 is a bottom plan view of the apparatus of FIG. 6 without the dial indicator and lock.

DETAILED DESCRIPTION OF THE PREFERRED EMBODIMENTS

Figure 1:
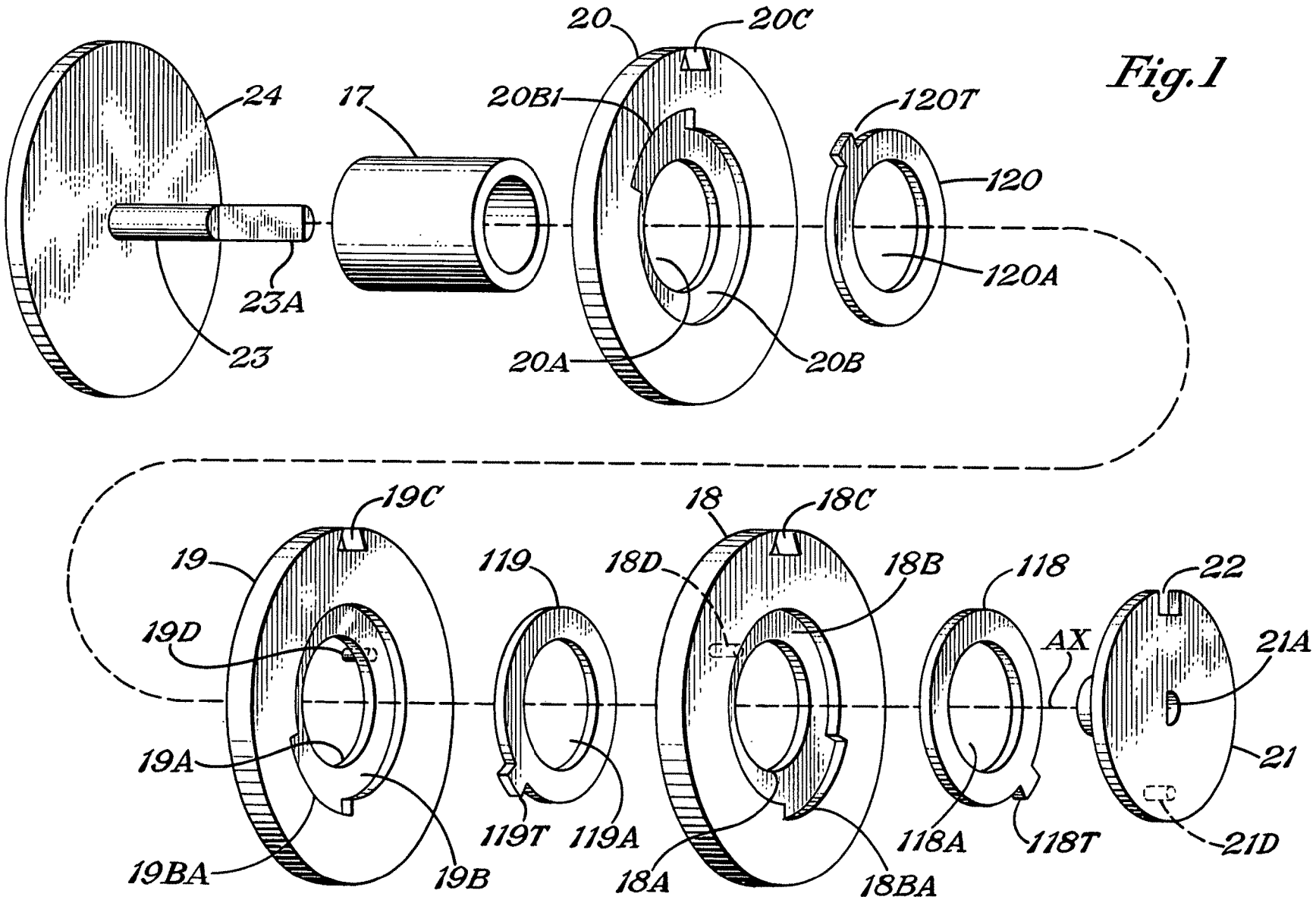
FIG. 1 is an exploded view of a portion of a padlock illustrating the backsides of three wheels, a dial, and a drive cam of the padlock.

Two type of padlocks with which the invention may be employed are model nos. 8088 and 8077AB produced by Sargent and Greenleaf, Inc. of Kentucky. Structure similar to that of these padlocks is disclosed in U.S. Pat. No. 2,673,457 and this patent is hereby incorporated into this application by reference. Referring to FIGS. 1-7 and also to U.S. Pat. No. 2,673,457, the padlock comprises a casing 11 and a movable shackle 26. Also provided is a rotatable dial and indicator 24 on the front face of the padlock which is connected by way of a drive shaft 23 to a drive cam 21 located inside of the casing. Rotation of the dial in either direction rotates the drive cam 21 in either direction. Extending into the internal portion of the casing and fixed thereto is a hollow cylindrical boss 17 around which are rotatably located three wheels 18, 19, and 20 which are located along the same axis AX in a side by side relationship with the second wheel 19 located between the third and first wheels 18 and 20 and with the drive cam 21 located rearward of and next to the third wheel 18. The wheels 18, 19 and 20 have central openings 18A, 19A, and 20A for receiving the cylindrical boss 17 such that the wheels 18, 19, and 20 may rotate about the cylindrical boss 17. The shaft 23 extends throughout the cylindrical boss 17 and through the wheels 20, 19, and 18 where its keyed end 23A is inserted into a mating aperture 21A of the cam 21 such that rotation of the dial 24 will rotate the drive cam 21. The cylindrical boss 21B of the drive cam 21 fits into the cylindrical boss 17. When upward pressure is applied to the shackle 26, a fence 29, 35 is moved toward the wheels and the drive cam. Gate slots 18C, 19C, 20C and 22 are formed in the edges of the wheels 18, 19, 20 and cam 21 respectively for receiving the mid portion 35 and end portion 29 of the fence when the gate slots 22, 18C, 19C, and 20C and 22 are axially aligned under the fence on the same side of the axis AX which is the proper position for opening the lock. In this position, when the fence is moved radially toward the three wheels and the drive cam, i.e. toward axis AX, the end portion 29 of the fence will be received in the gate slot 22 of the drive cam 21 and the mid portion 35 of the fence will be received within the gate slots 18C, 19C, and 20C of the wheels 18, 19, and 20 allowing the shackle to be opened when it is pulled in a direction away from the casing 11. If the drive cam slot 22 is not aligned with the axis AX on the proper side of the axis AX, the end portion 29 of the fence cannot enter into the slot 22 and the fence end portion 29 and intermediate portion 35 will ride on the edges of the cam 21 and the wheels 18, 19, and 20 respectively. If the gate slot 22 of the cam 21 is properly aligned, i.e. with the fence, the end portion 29 of the fence will be moved a small amount into the gate slot 22 when upward pressure is applied to the shackle, however, if the gate slot 18C, is not properly aligned, the intermediate portion 35 of the fence will ride on the edges of the wheels 18, 19, and 20. If gate slots 22 and 18C are properly aligned with the fence, the latter can move a small amount into the gate slots 22 and 18C even if the gate slots 19C and 20C are not properly so aligned. If gate slots 22, 18C and 19C are properly aligned, i.e. with the fence, the fence can move a small amount into the gate slots 22, 18C and 19C, even if the gate slot 20C is not properly so aligned. This is due to the imperfections of the wheels 18, 19, and 20 and the fact that the fence moves at a slight angular position relative to the axis AX as indicated by dotted line AN in FIG. 5 when it is moved toward the wheels 18, 19, and 20 and the cam 21.

Each of the wheels 18, 19, and 20 has a central recess 18B, 19B, and 20B in which are rotatably located annular rings 118, 119, and 120 respectively. Although not shown, each of the wheels 18, 19, and 20 are formed of two flat annular rings between which is located intermediate structure which defines the central openings 18A, 19A, and 20A and the recesses 18B, 19B, and 20B. The annular rings 118, 119, and 120 have central openings 118A, 119A, and 120A which have diameters equal to that of openings 18A, 19A, and 20A for freely receiving the cylindrical boss 17. Each of the recesses 18B, 19B, and 20B, has an outwardly extending angular portion 18BA, 19BA, and 20BA, for receiving outwardly extending tabs or flys 118T, 119T, and 120T of the rings 118, 119, and 120, which limit rotation of the rings 118, 119, and 120 in the annular recesses 18B, 19B, and 20B. The radial widths of the annular rings, 118, 119, and 120 from their central openings outward are smaller than that of the annular recesses 18B, 19B, and 20B such that when the rings 118, 119, and 120 are properly located, i.e. seated, in the annular recesses 18B, 19B, and 20B, slots are formed between the outside edges of the rings 118, 119, and 120 and the outside edges of the recesses 18B, 19B, and 20B. This is shown in FIG. 4 which is a plan rear view of the wheel 20 with its ring 120 located in the annular recess 20B. Extending from the front side of the cam 21, the wheel 18 and the wheel 19 are pins 21D, 18D, and 19D respectively which are adapted to fit into the slots of the wheels 18, 19, and 20 respectively between their rings 118, 119, and 120 and the outer edges of the recesses 18B, 19B, and 20B. The purpose of the pins 21D, 18D, and 19D and the recesses 18B, 19B, and 20B and the rings 118, 119, and 120 along with their tabs 118T, 119T, and 120T is to allow the drive cam 21 to rotate the wheel 18; the wheel 18 to rotate the wheel 19; and the wheel 19 to rotate the wheel 20. When the dial 24 is rotated, the drive pin 21D on the drive cam 21 will engage the tab 118T and rotate the wheel 18 which if rotated sufficiently its pin 18D will engage the tab 119T which will rotate the wheel 19 which if rotated sufficiently its pin 19D will engage the tab 120T and rotate the wheel 20. It takes one full revolution of the dial 24 and the cam 21 to be certain the cam 21 will cause the wheel 18 to rotate; one full revolution of the wheel 18 to be certain the wheel 18 will cause the wheel 19 to rotate; and one full revolution of the wheel 19 to be certain the wheel 19 will cause the wheel 20 to rotate.

The position of the pin 21D relative to the gate slot 22 of the drive cam 21 cannot change. Provision (not shown) however, is made for changing the relative positions of the pins 18D and 19D, and the outwardly extending angular recess portions 18BA, 19BA, and 20BA relative to their gate slots 18C, 19C, and 20C, to allow change of the combination numbers. For example, the portion of the wheel 18 next to the central opening 18A which defines the recess portion 18B and its pin 18D and its outwardly extending angular recess portion 18BA, can be varied relative to the gate slot 18C. Similarly, the pin 19D and the recess portion 19BA can be varied relative the gate slot 19C and the recess portion 20BA can be varied relative to the gate slot 20C. The arrangement for allowing these changes is not shown in the drawings but is part of the commercially available Sargent and Greenleaf locks defined above.

The opening procedure on a Sargent and Greenleaf padlock when the combination is known is four rotations of the dial 24 left to the first number; three rotations of the dial 24 right to the second number; two rotations of the dial 24 left to the third number; rotation of the dial 24 right to zero and then an outward pull on the shackle.

Referring to FIGS. 6, 7, and 8, the apparatus of one embodiment of the invention will be disclosed for determining the number combination of a locked padlock having a shackle and which is not attached to any structure. The apparatus comprises a frame 201 having two side walls 203 and 205, an end wall 207, a bottom portion 209, an open end 211 and a cavity 213 which is open from the top side 215 of the apparatus. A lever 221 is provided having an axle 223 which extends through openings formed through the side walls 205 and 203 and which has a rod-like cam member 225 which extends upward through an opening 209A formed through the bottom portion 209 into the cavity 213 as shown in FIGS. 6-8. A spring 227 is connected to the side wall 205 at the edge 205A and to the lever 221 which normally urges the lever 221 in an upward position and the cam rod 225 toward the open end to 211 of the frame. The casing 11 of the padlock is located in the cavity portion 213A and is secured in place by four thumb screws 229 which have their threaded shanks screwed into threaded apertures formed through the walls 203 and 205 to allow their ends to engage and hold the casing 11 fixed relative to the frame. In this position, the shackle 26 will be pointing toward the open end 211 and its U shaped portion will be located to the left of the cam rod 225 as seen in FIGS. 6-8 whereby the cam rod 225 will be urged by the spring 227 into pressure engagement with the shackle 26 so the shackle 26 is continuously biased towards its lock open position. The lever 221 may be rotated downward to rotate the cam rod 225 to the right as seen in FIGS. 6-8 to provide sufficient space to receive the shackle 26. After the padlock is secured in place, the lever 221 is released allowing the spring 227 to urge the cam rod 225 against the U portion of the shackle 26 to urge it towards the open position.

Also provided is a movement detector or sensing device 231 having a dial indicator 235 for visually displaying the amplitude of movement detected. Device 231 has a linearly movable movement transmitting member or plunger 233 which is sensitive to movement and urged normally away from the body 234 of the indicator. Device 231 is a commercially available dial indicator gage with a rotatable indicator needle 235A of the type produced by Federal of Providence, R.I., model no. C21. The dial indicator has dial markings to indicate the angular position of the needle 235A. The gage is a movement multiplier whereby a slight linear movement of plunger 233 is greatly amplified by the circumferential travel of the dial needle 235A. Linear movement of plunger 233 toward the body 234 causes the needle to be rotated, i.e., move around the dial face to give a reading or measurement proportional to the amount of movement of the plunger. The back side of the body 234 has a threaded aperture and the body 234 of the device 231 is attached in place in the cavity portion 213B next to the opening 211 with its movable means 233 next to the shackle 26. The frame has a bottom plate 209B attached to the bottom of the sides 203 and 205. The plate 2098 has an aperture 209C through which a bolt 241 is inserted and its threaded shank screwed into the threaded aperture formed in the bottom of the body 234 of the device 231. In the position shown in FIGS. 6 and 7, the rod cam 225 is urged by the spring 227 against the inside of the U portion of the shackle 26 which is thereby urged against the plunger 233 of device 231. Thus, movement of the shackle 26 may be transmitted to the plunger and in turn converted through known means, not shown, in device 231 to rotational movement of the dial 235 indicator needle. In the position of the padlock shown in FIGS. 6 and 7, the dial 24 of the padlock faces upward relative to the frame 201.

In carrying out the process for determining the three number combinations of the lock, the first procedure is to find the last number of the combination. The dial 24 of the padlock from position zero is rotated four times left to zero which turns all of the three wheels 18, 19, and 20 to numerically zero positions. By turning the dial 24 four times to the left, all of the wheels 18, 19, and 20 are in a position to be moved together by movement of the dial 24 and hence the cam drive 21 toward the left. At this point, an initial reading is taken of the device 231 to determine the position of the needle 235A relative to dial indicator 235. From the zero position of the dial 24, the dial 24 is then turned left to the one position and then back to zero and a reading taken of the needle 235A. Next the padlock dial 24 is moved left to the number two position and then back to zero and a reading taken of the needle 235A. When the dial 24 is at the zero position, the gate slot 22 of the cam drive 21 is in alignment with the fence of the padlock. By moving the lock dial 24 one number at a time and back to zero, the three wheels 18, 19, and 20 are incrementally moved and the gate slot of the third wheel 18 is incrementally moved toward alignment with the fence. By moving the dial 24 and hence the drive cam 21 back to zero after the gate slot of the third wheel 20 is incrementally moved, the gate slot 22 of the cam 21 is moved in alignment with the fence. When the gate slot 22 of the drive cam 20 and the gate slot 18C of the third wheel 18 are in alignment with the fence, when the fence is forced toward the wheels 18-20 and cam 21, it will fall a small amount into the gate slot 18C of the wheel 18 and a small amount in the gate slot of the cam 21 since the wheels when made on a commercial basis are not perfectly round and moreover, the fence is not forced towards the wheels parallel to the axis AX but at an angle relative to the axis of the wheels, as indicated previously, to make sure that the fence fits into the gate slot 22 of the cam 21 in the opening process. When the fence can move a small amount into the gate slot 18 and 22, a noticeable change in position will be made by the dial needle 235A and the position of the dial 24 of the padlock will give the third number of the combination. In most cases, the noticeable change in position by the dial needle 235A will be large. However, in some cases, the noticeable change in position of the needle may not be large. In any event, if a noticeable change is observed, an incremental movement of the wheel 18 to the next number is made to determine if the noticeable change in the position of the needle was due to the fence partially entering its gate slot or due to a manufacturing defect in the wheel 18. The operator can determine if the fence moved partially into the gate slot of the wheel 18 by manipulating the dial 24 to move the gate slot of the wheel 18 another increment representing the next number. If at the next increment, the needle 235A moves back to the position it was at just before the noticeable change in position took place, then the operator will know that the fence moved partially into the gate slot of the wheel and out of the gate slot, thus identifying from the position of the dial 24 the third number of the combination when the fence moved into the gate slot. If at the next increment of the wheel as read by the dial numerals, however, the needle 235A stays at its new position, the operator will know that the noticeable change in position of the needle was not due to the fence moving partially into the gate slot of the wheel but due to a manufacturing defect in the wheel. This procedure will be followed for each wheel of any lock to determine its combination number when a noticeable change in the defection of the needle is seen in order to determine the combination number for that wheel.

At this point, the operator can now start looking for the combination number of the second wheel 19. This is done by rotating the padlock dial 24 four times to the right to move all of the wheels to a position such that they are ready to move to the right. This is necessary since the number two wheel 19 of the combination of this lock is set by going right. Assume that the last number of the combination is 30. Most persons setting combination locks leave a window between combination numbers of three numbers wide since if the combination numbers are placed too close together, the lock may be openable on one or two numbers of the combination. Thus when rotating the dial four times to the right, it will be rotated from zero four times to the right and then to number 27. Now the operator must place wheel 18 back to 30. To do this, the operator will dial the lock left passing 30 once and then stopping on 30 the second time it comes around. This puts the gate slot 18B of the third wheel 18 under the fence. Then the operator will move the dial 24 right to zero and a measurement taken. This dialing procedure is followed going down one number at a time all the way back to 30 or whichever the third number may be until a noticeable change in position of the needle 235A is seen requiring another incremental move of the wheel 19 to determine if the noticeable change in position of the needle 235A was due to the fence partially entering its gate slot by needle movement back to its prior position before the change was noted or due to a manufacturing defect in the wheel 19. In this manner, the operator will obtain the second number of the combination. In this respect, from zero, the operator will rotate the dial 24 to the right to 26 and left to 30 and past 30 and stop on 30 the second time. This places the first and second wheels at 26 and the third wheel at 30. The operator will then rotate the dial 24 back to zero and an indicator measurement taken. If a noticeable change in position of the needle 235A is not seen, the operator will then move the dial 24 right to the number 25 and then left to 30 and past 30 and stopping on 30 the second time and then right back to zero and a measurement taken, i.e. the position of the needle 235A is noted. What is happening is that the gate slot of the second wheel is incrementally moved toward the fence. With this procedure, when the gate slot of the second wheel is moved under the fence, both the third and the second gate slot 18C and 19C and gate 22 will be aligned and the fence will move a small amount into the gate slots, when outward pressure is applied to the shackle providing a noticeable change in position of the dial needle 235A. The noticeable change in position of the dial needle provides an indication to the operator that he should move the second wheel another dial increment to determine if the noticeable change was due to the fence partially entering its gate slot (and hence providing information from the position of the dial 24 as to, i.e. identifies, the second number of the combination) or due to a manufacturing defect in the wheel 19. Assume that the second number of the combination is the number 20.

In order to find the first number of the combination, the operator can subtract, in most instances, three numbers from the second number due to the three number window between combination numbers. If the second number is 20 and third number is 30, the operator can start dialing the combination at 17 moving the second and third wheels to 20 and 30 taking a reading or measurement on the indicator, and then moving the second dial to 16 and repeating the procedure and making measurements each time until a noticeable change in the dial needle is seen to enable the operator to determine the first number or the lock opens. This procedure for finding the first number of the combination can be done with the lock out of the device 201 since there are only 50 combinations to test for. Specifically, to find the first number of the combination after the second number is found the dial 24 is at zero. The operator will rotate the dial 24 four times to the left and then to 17; three times to the right to 20; two times to the left to 30; and back to zero. This moves the second and third wheels to the 20 and 30 positions placing their gates slots and gate slot 22 under the fence, and a dial reading or measurement is then made. If noticeable change in the dial needle 235A is not seen, the dial 24 is rotated four times to the left to 16; three times to the right to 20; and two times to the left to 30 and then back to zero and a measurement taken and continue with this type procedure, i.e. rotate to 15, 14, 13, etc. until the lock opens.

As an alternative, in order to find the first number of the combination, after the third and second numbers have been found and the dial 24 is on zero, the dial 20 can be turned four times to the left to the number one on the dial; back to the right to 20 and past 20 twice stopping on 20 the third time and then to the left to 30 passing 30 once and stopping on 30 the second time; then right to zero and a measurement taken either with the lock in the device 201 or by pulling on the shackle to determine if the shackle opens. If the shackle does not open or the dial needle does show a noticeable change in position, the procedure is repeated using the next dial number or increment. In this respect, the dial 24 would be rotated to the left four times to the number two on the dial; back right to 20 passing 20 twice and stopping on 20 the third time and then back to 30 left passing 30 once and stopping on 30 the second time; and then back to zero and a measurement taken to determine if the needle 235A makes a noticeable change in position to enable the operator to determine the first number or the shackle 26 pulled to determine if it will open and continue this procedure with the next number (3) until the lock opens.

An alternative method of finding the third number of the combination, if the first method mentioned above does not work, is to rotate the dial 24 to the right four times to zero and then turn the dial 24 left to one and then back to zero and a measurement taken. If the position of the dial needle 235A does not change noticeably, then the dial 24 is moved to the left to the number two and then back to zero and a measurement taken to determine if the dial needle makes a noticeable change in position and return as described above, to enable the operator to determine the third number. This procedure may by useful if the first and second wheels 20 and 19 have high spots and in effect hide the gating of the third wheel. What is being done in this case is that the first and second wheels 20 and 19 are parked at zero and the third wheel is the only one which is moved incrementally. This method is used only when the wheel gate of the third wheel cannot be found using the first method mentioned above.

When the lock is in the device 201, the lever 221 should be moved down to release the pressure by the rod cam 225 on the shackle in order to allow easy rotation of the dial 24 and hence of the wheels inside of the lock. Measurements are taken by releasing the lever 221 to allow the spring 227 to move the rod cam 223 against the U portion of the shackle 26 to move it against the plunger 233 of the movement sensing device 231.

Figure 9:
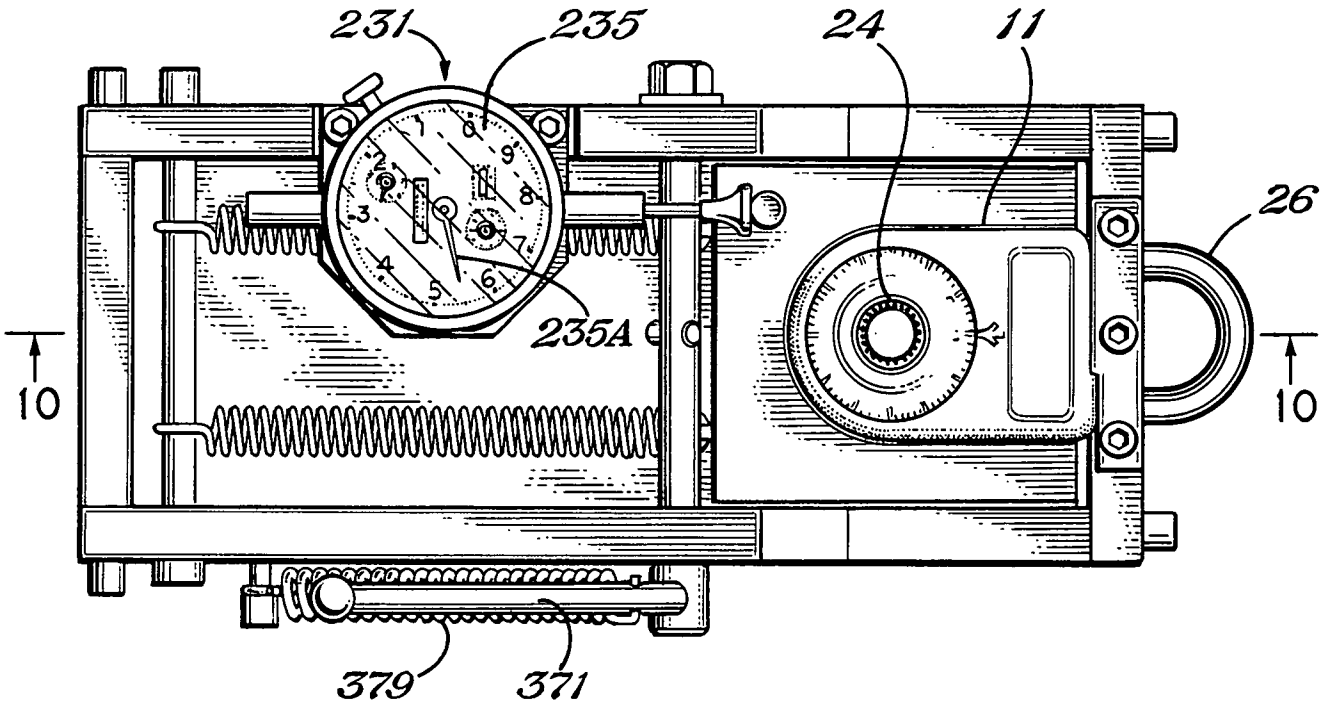
FIG. 9 is a top plan view of another embodiment of the apparatus of the invention.
Figure 10:
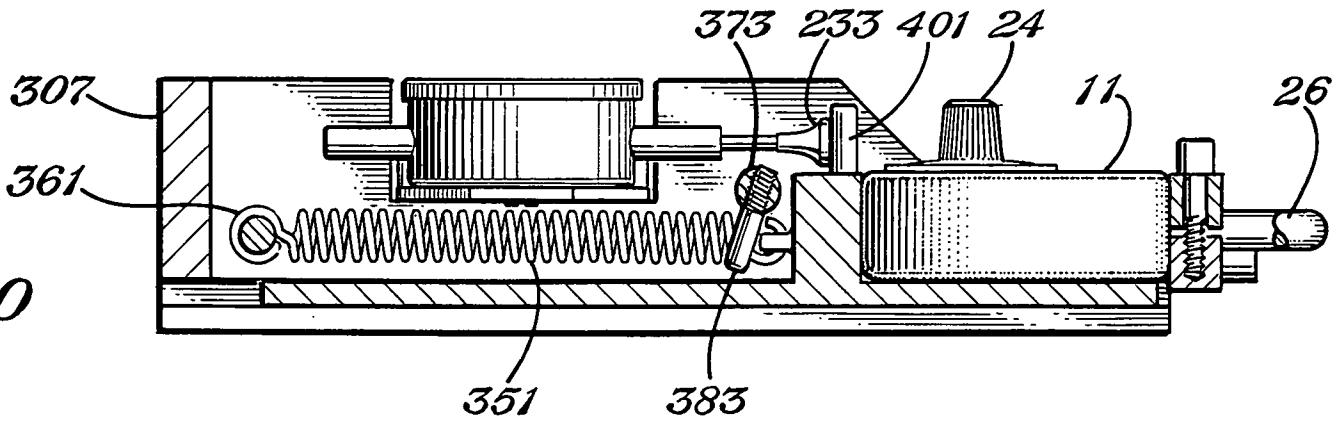
FIG. 10 is a cross-sectional view of the frame of FIG. 9 taken along the lines 10-10 thereof.
Figure 11:
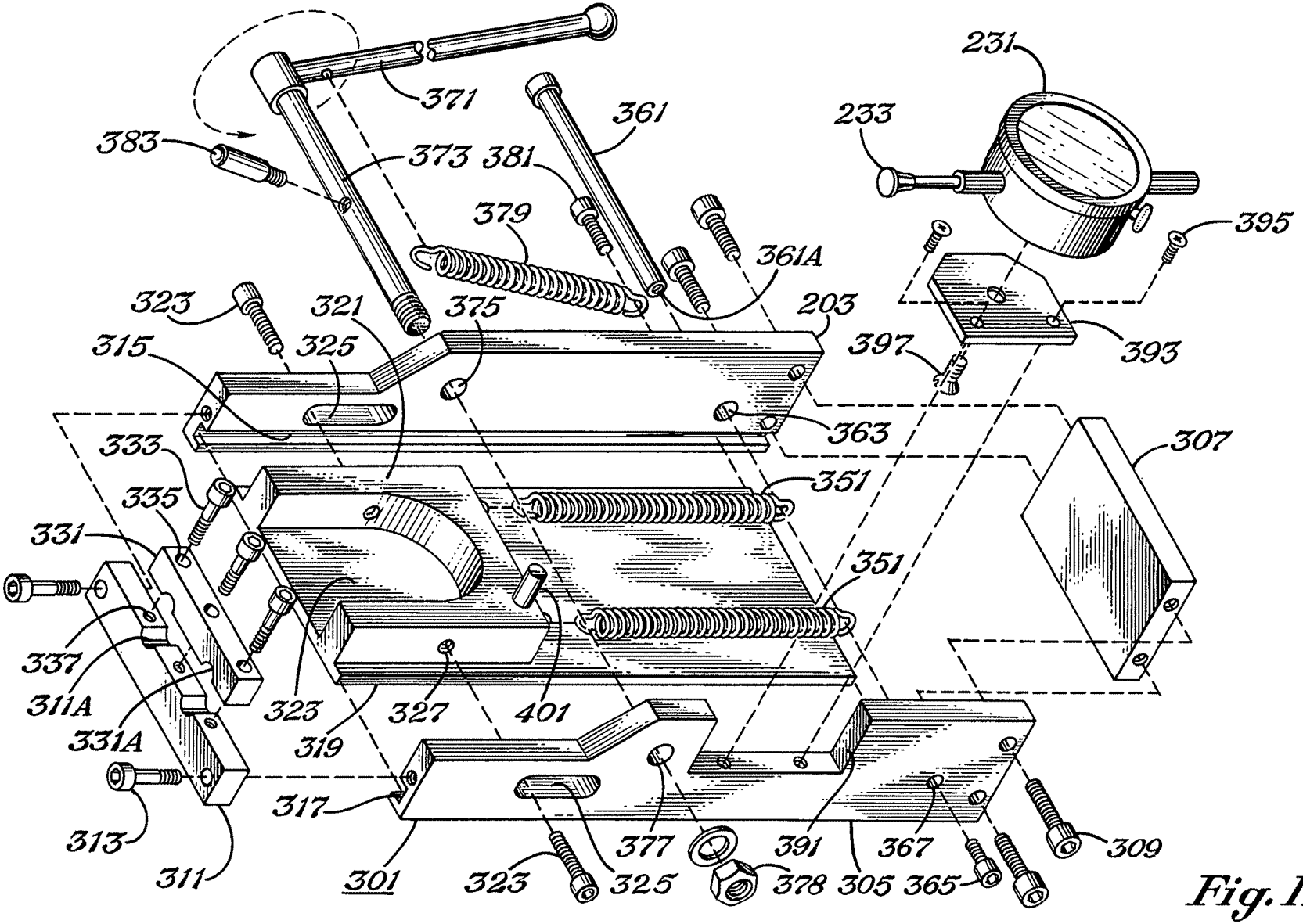
FIG. 11 is an exploded view of the apparatus of FIG. 9.

Referring now to FIGS. 9, 10, and 11, there will be described another embodiment of the apparatus which allows the padlock number combination to be found while its shackle 26 is secured around a device to be locked, e.g. when the lock is locked in place on a cabinet hasp. The procedure for finding the three numbers of the combination is the same as that described above. The apparatus 301 of FIGS. 9, 10, and 11 comprises a frame formed by two side walls 303 and 305 having an end wall 307 secured to their ends by bolts 309 and another end wall 311 secured to their other ends by bolts 313. The side walls 303 and 305 have grooves 315 and 317 formed therein along their bottoms for slidably receiving a block member 319. The length of the block 319 is sufficient such that it can slide back and forth in the grooves 315 and 317 a slight amount between the end walls 307 and 311. The block 319 has a larger portion at 321 with a U shaped cavity 323 formed therein for receiving the casing 11 of the padlock. The casing of the padlock is releasably fixed in place by set screws 323 which can be inserted through slots 325 in the walls 303 and 305 and screwed into threaded apertures 327 formed in the side walls of the block portion 321 to engage the casing 11 of the lock and secure it in place relative to the slidable block 319. The shackle 26 is secured to the end wall 311 by a small clamp 331 and bolts 333 which clamp the shackle between the end wall 311 and the block 331. In this respect, the bolts 333 are inserted through apertures 335 formed through the clamp 331 and screwed into threaded apertures 337 formed in the end wall 311 to clamp the shackle to the end wall 311 and hence to the frame 301 and which prevents the shackle 26 from moving relative to the frame. Slots 311A and 331A are formed in the end wall 311 and in the clamp 331 for receiving the shackle 26. Two springs 351 have ends connected to the block portion 321 and their other ends connected to a rod 361 which extends through an aperture 363 formed through the wall 303 and is secured in place by a bolt 365 which extends through an aperture 367 formed in the wall 305 and is screwed into a threaded aperture 361A formed in the end of the rod 361. The springs 351 thus urge the block 319 and hence the casing 11 of the padlock away from the shackle which is held fixed to the frame 301 thus urging the shackle to its open position relative to the casing 11 of the padlock. A lever 371 is connected to a rod 373 which extends through apertures 375 and 377 formed through the walls 303 and 305 and is held in place by a nut 378 screwed the threaded end of the rod 373. A spring 379 is connected to the lever 371 and to a bolt 381 which is attached to the side wall 303. The purpose of the spring 379 is merely to hold the lever 371 in an upward position. Connected to the rod 371 is a cam rod 383. The purpose of the lever 371 and the cam rod 383 is to allow the block 319 and hence the lock casing 11 to be moved toward the shackle 26 to release the pressure for dialing purposes. This is done for example by moving the lever 371 downward to the right as seen in FIG. 11 which causes the end of the cam rod 383 to be moved against the bottom portion of the block portion 321 to move it toward the shackle which is fixed in place to the frame which releases the force between the shackle and the casing and facilitates rotation of the dial 24. The lever 371 and cam rod 383 also are employed to facilitate insertion of the padlock in the apparatus.

A slot 391 is formed in the side wall 305 in which is attached a plate 393 by bolts 395. The plate 393 in turn is attached to the bottom of the body 234 of the movement sensitive device 231 by a bolt 397. In this position, the body 234 of the movement sensing device 231 cannot move and its movable plunger 233 extends towards the end plate 311 and engages a pin 401 which is connected to the block portion 321 of the block 319 when the springs 351 urge the block 319 towards the end 307. Thus the device of FIGS. 9, 10, and 11, allow the movement sensing device 231 to measure movement of the block 319 and of hence the casing 11 relative to the shackle to allow one to find the gates slots of the wheels 18, 19, and 20 of the lock while the shackle 26 is fixed in place relative to the frame 301 and relative to the casing 11 of the padlock.

The invention herein described provides a savings in the price of the padlocks since even though locked and the combination unknown, they need not be discarded but the combination can be readily determined so the lock can be opened. Moreover, there is no damage to the lock and no visible signs of entry and therefore the entire cost of the lock is saved.

The apparatus of FIGS. 6-11 of the invention and the basic principle of the method also can be used to determine the combination of other types of combination padlocks, utilizing a shackle and having slotted wheels and a fence type release. Such padlocks may comprise a casing and a shackle and instead of three wheels and a drive cam, only two wheels and a drive cam all with gate slots such that the cam acts as one of the wheels or tumblers. The fence in these type locks does not have an outer end portion similar to that of end portion 29 of FIG. 5 and is a single member. The drive cam functions as one of the wheels. The procedure for determining the three combination number of these locks is as follows. First the third combination number is found which is determined by the drive cam. At the zero position of the dial, the gate slot of the drive cam is not aligned with the fence. With the dial being located at zero, the dial is rotated three times right to zero. From zero the dial 24 of the padlock is rotated to number one and an indicator measurement made. Instead of going back to zero the dial is rotated to number two and a measurement made (while the shackle is urged to its open position) and so forth until a noticeable change in position and movement to a lower amplitude reading on turning of the dial to the next increment is made by the needle 235A to enable the operator to determine the third combination number. This procedure incrementally moves the gate slot of the drive cam and hence the third wheel in alignment with the fence. Assume that the third combination is the number 20. These locks also normally have a three number window between combinations. From the position 20, the padlock dial is rotated three times left to 17, right to 20 and a measurement made. If this is not the second combination number, from 20, the dial of the padlock is rotated left to 16 and right to 20 and a measurement made. This procedure incrementally moves the second gate slot in alignment with the fence (and the third gate slot in alignment with the fence when a measurement is made). When the second and third gate slots are in alignment with the fence, a noticeable change in position of the needle 235A will be made when the shackle is urged to its open position and if upon turning the dial to the next increment or number the indicator needle moves back to the reading position before the change, this indicates to the operator the second number of the combination. Assume that the second combination number is 14. At this point the operator can take the padlock out of the apparatus and start at the number 11 to find the first combination number. From the number 14, the operator will rotate the dial to the right to 11 and stop on 11. From 11, the operator will rotate the dial left to 14, past 14 once and stop on 14 the second time. Then the operator will rotate the dial right to 20 and stop on 20 and pull the shackle. If the shackle does not open, the operator will then rotate the dial right to 10, stop on 10, left to 14, past 14 once and stop on it the second time and then right to 20 and stop on 20 and pull the shackle. The procedure will be repeated until the first combination number is found. This procedure incrementally moves the third gate slot in alignment with the fence (and the third and second gate slots in alignment with the fence when a measurement is made). When all three gate slots are in alignment with the fence a noticeable change in position of the needle 235A will occur enabling the operator to determine the first number of the combination and the shackle will open when force is applied to open the shackle.

The invention claimed is:

1. A method of determining the three number combination of a locked padlock of the type having a casing, a shackle, an incrementally numerically divided rotatable dial on the outside of the casing and having a shaft extending into the casing and connected to a drive cam for rotating the drive cam upon rotation of the dial, first, second, and third wheels rotatable about a cylindrical member, with the second wheel being located between the first and third wheels and the third wheel being located next to the drive cam and all of the three wheels and the drive cam being rotatable about the same axis and each having a gate slot in its edge for receiving a fence which is movable toward the three wheels and the drive cam upon force being applied to the shackle in a direction to move the shackle to an open position, said fence having an intermediate portion and an extending end portion located in a plane different from that of said intermediate portion, each of the three wheels having a slot means in one side and a movable key located in the slot means with all of the slots means of the three wheels facing in the same direction toward the drive cam and the drive cam and the third and second wheels each having a pin on one side thereof located in the slot means of the third, second, and first wheels respectively whereby rotation of the dial and drive cam will rotate the third wheel which in turn can rotate the second wheel which in turn can rotate the first wheel to align all of the gate slots to allow the fence to fit fully into all of the gate slots to allow the shackle to be moved to an open position, said method comprising the steps of:

rotating the dial to cause the cam to incrementally move the gate slot of the third wheel in alignment with the fence, rotating the dial and the drive cam to align its gate slot with the fence and applying a force to the shackle in a direction to urge it to its open position and obtaining a measurement representative of the amount of movement between the shackle and the casing to find the third number of the combination reflected by movement of the shackle when the gate slots of the third wheel and of the drive cam are aligned with the fence, rotating the dial to incrementally move the gate slot of the second wheel in alignment with the fence and to move the gate slots of the third wheel and the drive cam in alignment with the fence and applying a force to the shackle in a direction urging it to its open position and obtaining a measurement representative of movement between the shackle and the casing to find the second number of the combination reflected movement of the shackle when the gate slots of the third and second wheel and the drive cam are aligned with the fence, rotating the dial in a manner to manipulate the dial to incrementally move the gate slot of the first wheel in alignment with the fence and the gate slots of the second and third wheel and of the drive cam in alignment with the fence to obtain the first number of the combination and/or to open the shackle of the padlock.

2. A method of determining the three number combination of a locked padlock of the type having a casing, a shackle, a rotatable dial having position indicating marking thereon on the outside of the casing for rotating first, second and third wheels about a common axis with each wheel having a gate slot in its edge for receiving a fence which is movable toward the three wheels upon force being applied to the shackle in a direction to urge the shackle to an open position, wherein rotation of the dial rotates the third wheel which in turn can rotate the second wheel which in turn can rotate the third wheel to align all of the gate slots to allow the fence to fit fully into all of the gate slots to allow the shackle to be moved to an open position, said method comprising the steps of:

rotating the dial to incrementally move the gate slot of the third wheel in alignment with the fence, applying a force to the shackle in a direction to urge it to its open position and, with a movement sensing means, visually obtaining a measurement representative of movement between the shackle and the casing to find the third number of the combination reflected by movement of the shackle when the gate slot of the third wheel is aligned with the fence, rotating the dial to incrementally move the gate slot of the second wheel in alignment with the fence and to move the gate slot of the third wheel in alignment with the fence and applying a force to the shackle in a direction to urge it to its open position and with said movement sensing means, visually obtaining a measurement representative of movement between the shackle and the casing to find the second number of the combination reflected by movement of the shackle when the gate slots of the third and second wheels are aligned with the fence, rotating the dial to incrementally move the gate slot of the first wheel in alignment with the fence and the gate slots of the second and third wheel in alignment with the fence to obtain the first number of the combination and/or to open the shackle of the padlock.

3. The method of claim 2, wherein:

said movement sensing means amplifies the amount of movement between the shackle and the casing for visual viewing.

4. For determining one or more numbers of the combination for opening of a locked combination type padlock having a casing or body, a locking shackle and a series of wheel-like, notched tumblers which can be turned in a known manner by a rotatable dial to successively position the tumbler notches into alignment with a fence whereupon an opening force on the lock shackle will effect opening of the lock, the dial having incremental markings for indicating its rotational angular movement from a zero position, the method comprising:

a. utilizing a sensing device to indicate a value of relative movement occurring between the shackle and the body of the lock when a lock-opening force is applied therebetween;

b. rotating the dial to successive dial increments;

c. applying a lock opening force between the lock body and shackle at each of said successive increments;

d. determining from the value provided by the sensing device when relative movement occurs between the lock body and shackle at each said successive increments; and e. noting as one number of the combination the dial position when the value indicated for the relative movement due to one of said successive dial increments returns to the value of the dial increment immediately prior thereto.

5. The method of claim 4, wherein said value is a measurement sensibly determinable.

6. The method of claim 5, wherein said sensibly determinable measurement comprises a visual display.

7. The method of claim 6, wherein said visual display comprises a dial gauge.

* * * * *